US005546657A

United States Patent [19]

Mehta et al.

[11] Patent Number: 5,546,657

[45] Date of Patent: Aug. 20, 1996

[54] METHOD OF ASSEMBLING WIRING DEVICES IN CONTINUOUS SUCCESSION

[75] Inventors: Parag J. Mehta, Copiague; Gunter Callas, Woodbury; Vincent Barbo, Greenlawn; Jean-Claude Marcou, DeWitt, all of N.Y.

[73] Assignee: Pass & Seymour, Inc., Syracuse, N.Y.

[21] Appl. No.: 383,443

[22] Filed: Feb. 3, 1995

[51] Int. Cl.[6] ..... H01R 9/14

[52] U.S. Cl. ..... 29/884; 29/33 M; 264/272.11

[58] Field of Search ..... 29/418, 33 M, 29/884, 885, 866, 760; 264/272.11

[56] References Cited

U.S. PATENT DOCUMENTS

| | | | |
|---|---|---|---|
| 3,574,929 | 4/1971 | Michik | 29/884 X |
| 3,698,074 | 10/1972 | Helda et al. | 29/418 X |
| 4,070,752 | 1/1978 | Robinson | 29/884 |
| 4,774,764 | 10/1988 | Seidel et al. | 29/866 X |
| 4,895,536 | 1/1990 | Gingerich et al. | 439/885 |
| 4,963,107 | 10/1990 | Koster | 29/884 X |
| 5,194,018 | 3/1993 | Lopa et al. | 29/884 X |
| 5,263,241 | 11/1993 | Hart et al. | 29/760 X |

FOREIGN PATENT DOCUMENTS

| | | | |
|---|---|---|---|
| 5-298955 | 11/1993 | Japan | 29/884 |

*Primary Examiner*—Carl J. Arbes
*Attorney, Agent, or Firm*—Charles S. McGuire

[57] ABSTRACT

A method of automatically assembling wiring devices of the type having mounting straps in a continuous sequence, the disclosed wiring device being a duplex wall receptacle. A strip of the mounting strap material is fed longitudinally, being alternately moved by equal increments and stopped to place each segment of the strip progressively at a plurality of operational stations. Portions of the strip are removed to form blanks for the mounting straps which remain mutually attached at positions along each side of the strip which form end portions of the blanks and, ultimately, of the mounting straps. One or more additional strips in which ground contact blanks have been formed are fed in a direction perpendicular to that of the first strip and the ground contact blanks are staked to the mounting strap blanks and severed from their respective strips. Front and rear housing sections, the latter having terminal members positioned therein, are moved from opposite sides of the strip in which the mounting strap blanks are formed into mutual engagement, enclosing a medial portion of the mounting strap. At the endmost station, the strip is severed to provide a fully assembled wiring device.

20 Claims, 7 Drawing Sheets

METHOD OF ASSEMBLING WIRING DEVICES IN CONTINUOUS SUCCESSION

BACKGROUND OF THE INVENTION

The present invention relates to methods of assembling a plurality of elements to produce an electrical wiring device of the type having a mounting strap for supporting the device in a junction box, or the like. More specifically, the invention relates to a method of assembling wiring devices such as wall receptacles in a continuous sequence in a fully automated manner.

As labor costs have risen over the years, automated assembly of products from a plurality of separately fabricated elements has steadily become more popular. One of the principal requirements in automated assembly of a number of diverse parts is the precise positioning and indexing of the parts as they are placed by robotic or other automated means in the required relative positions. Achieving this requirement is often the most difficult and costly element in the implementation of the process. This is notably the case in the automated assembly of electrical wiring devices.

It is a principal object of the present invention to provide a novel and improved method of assembling electrical wiring devices.

Another object is to provide a highly reliable yet relatively inexpensive method of assembling electrical wiring devices.

A further object is to provide an automated method of producing wiring devices of the type having a mounting strap which involves steps in the fabrication of the mounting strap as well as assembly therewith of separately fabricated elements.

Still another object is to provide a novel method of producing electrical wiring devices in a rapid, continuous sequence.

Other objects will in part be obvious and will in part appear hereinafter.

SUMMARY OF THE INVENTION

The invention is disclosed in the context of automated assembly of a duplex wall receptacle of the type disclosed in copending application Ser. No. 08/181,042, now U.S. Pat. No. 5,472,350 of the present inventor. The receptacle basically consists of five elements, namely, front and rear housing sections, a pair of terminal elements and a mounting strap, plus screws inserted in the terminals and strap for connection thereto of hot, neutral and grounding conductors and screws extending through openings in end portions of the strap for mounting the device in a junction box, or the like. Also, ground contacts for receiving the grounding prongs of electrical plugs are staked to the mounting strap.

In the assembly method of the invention, a continuous, elongated strip of galvanized steel, or other material from which the mounting straps are formed, is fed in the direction of the longitudinal axis of the strip. The strip is sequentially moved and stopped, the distance of each movement being equal to the width of one of the finished mounting straps, plus the width of a scrap portion. At a first position or station at which strip movement stops, openings are cut or punched by conventional tooling at predetermined positions to form a blank from which a finished mounting strap will be formed. Also, threads are formed in two of the punched openings. At the next two stations, separate, elongated strips of copper, previously cut in predetermined areas to form blanks which will become ground contacts, are fed in directions parallel to their respective longitudinal axes and perpendicular to the axis of the first strip. At each of these two stations one of the ground contact blanks is severed from its respective strip, moved downwardly and staked to a mounting strip blank in covering relation to respective ones of the openings previously formed therein.

At succeeding stations, the mounting strap and ground contact blanks are further formed by bending operations and a screw is inserted in one of the tapped openings in the mounting strap blank; the rear housing section is moved upwardly into mating engagement with and staked to a mounting strip blank; the two terminals with conductor connection screws fully inserted are moved downwardly into positions within the rear housing section; the junction box mounting screws are moved downwardly through respective openings in opposite end portions of the mounting strip blank and cardboard retainers are placed on the mounting screws; and the front housing section or cover is moved downwardly into mating engagement with the rear housing section, and the two sections are joined by ultrasonic welding. During all of these operations the mounting strap blanks remain rigidly connected in side-by-side relation to one another at opposite end portions thereof. As a final step, the scrap portion is removed between the endmost mounting strap and the next preceding mounting strap to provide a fully assembled receptacle. Electrical testing may be performed, if desired, before the receptacles are severed from the continuous strip. The conductor connecting screws are backed out of their respective tapped openings in the terminals by robotic screwdrivers before final packaging.

The foregoing and other features of the invention will be more readily understood and fully appreciated from the following detailed disclosure, taken in conjunction with the accompanying drawings.

DETAILED DESCRIPTION

Figure 1:
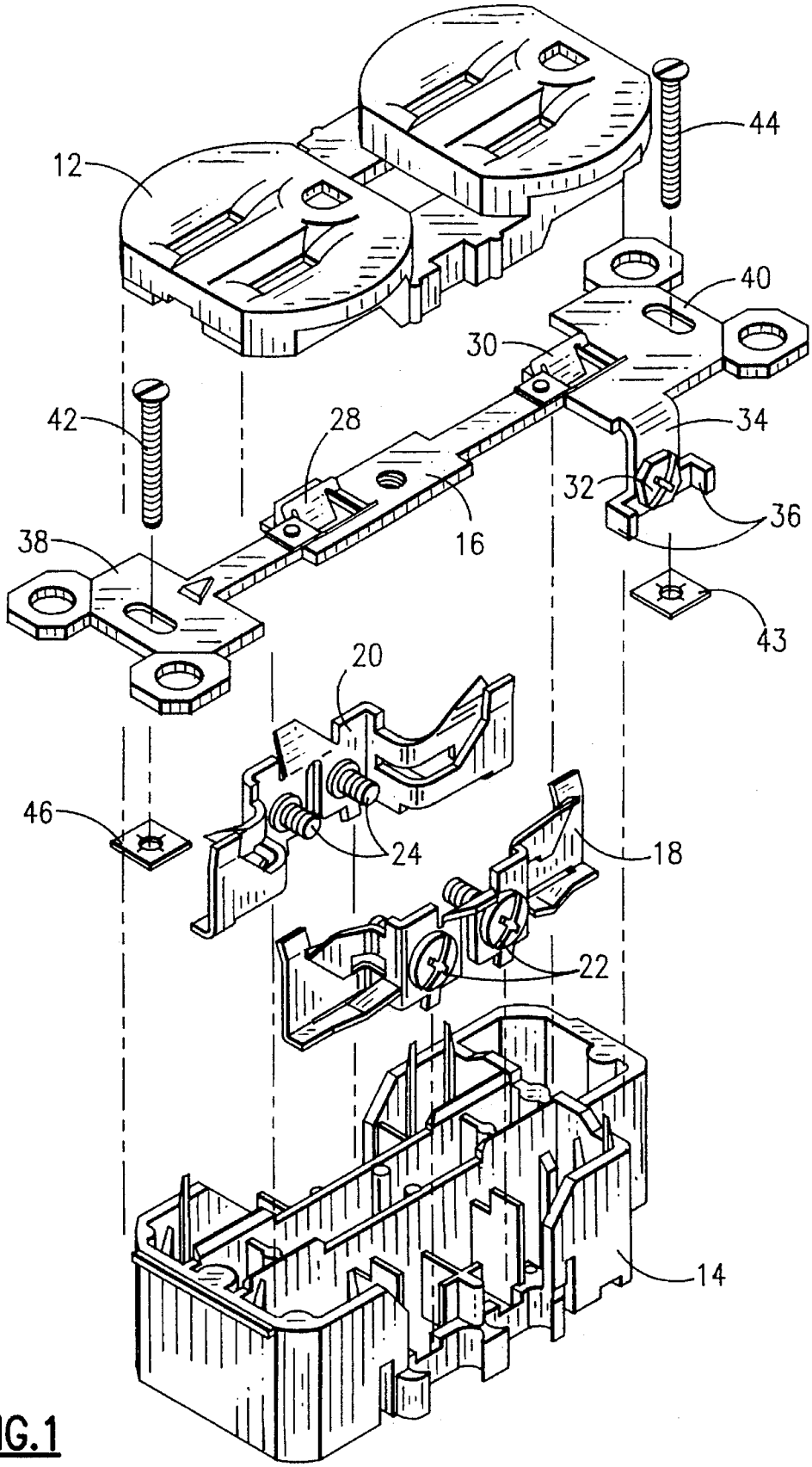
FIG. 1 is an exploded, perspective view of a duplex wall receptacle, representing an electrical wiring device of the type assembled by the present invention.
Figure 2:
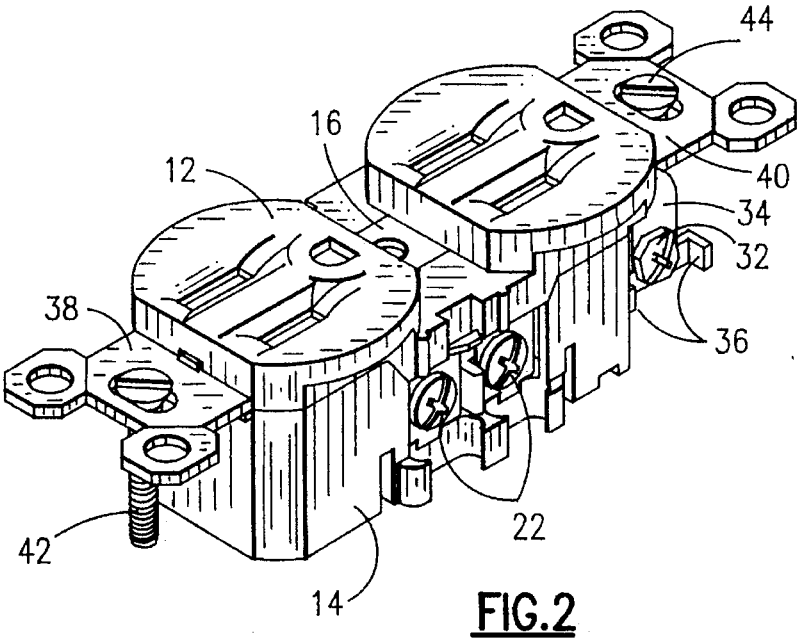
FIG. 2 is a perspective view of the receptacle of FIG. 1 in fully assembled condition.

Referring now to the drawings, an electrical wiring device in the form of a duplex receptacle, denoted generally by reference numeral 10, is seen with its component elements in exploded, perspective view in FIG. 1, and in fully assembled condition in FIG. 2. Receptacle 10 is identical to the receptacle which is the subject of the previously referenced U.S. patent application, which is incorporated herein by reference for any details which may be useful in the further understanding of the present invention.

Receptacle 10 includes front and rear housing sections, termed cover 12 and base 14, respectively, mounting strap 16 and a pair of terminals 18 and 20. Respective pairs of screws 22 and 24 engage threaded openings in terminals 18 and 20 for securing the stripped ends of electrical wires thereto. Cover 12 includes two sets of openings through which the blades of a pair of electrical plugs may be inserted for engagement by female contacts of terminals 18 and 20, and by ground contacts 28 and 30 each staked to mounting strap 16 over respective openings therein. The mounting strap is commonly formed from a sheet of galvanized steel and the grounding contacts from a sheet of copper alloy. Screw 32 engages a threaded opening in depending tab 34 on mounting strap 16 and ears 36 extend outwardly on each side of the screw head to assist in looping the ground wire around screw 32 during installation. End portions 38 and 40 of strap 16 extend outwardly from opposite ends of the fully assembled receptacle, and screws 42 and 44 extend loosely through openings in the respective strap end portions for mounting receptacle 10 in a standard junction box. Screws 42 and 44 are retained in the strap openings prior to installation by cardboard retainers 46 and 48, as is conventional.

Figure 3:
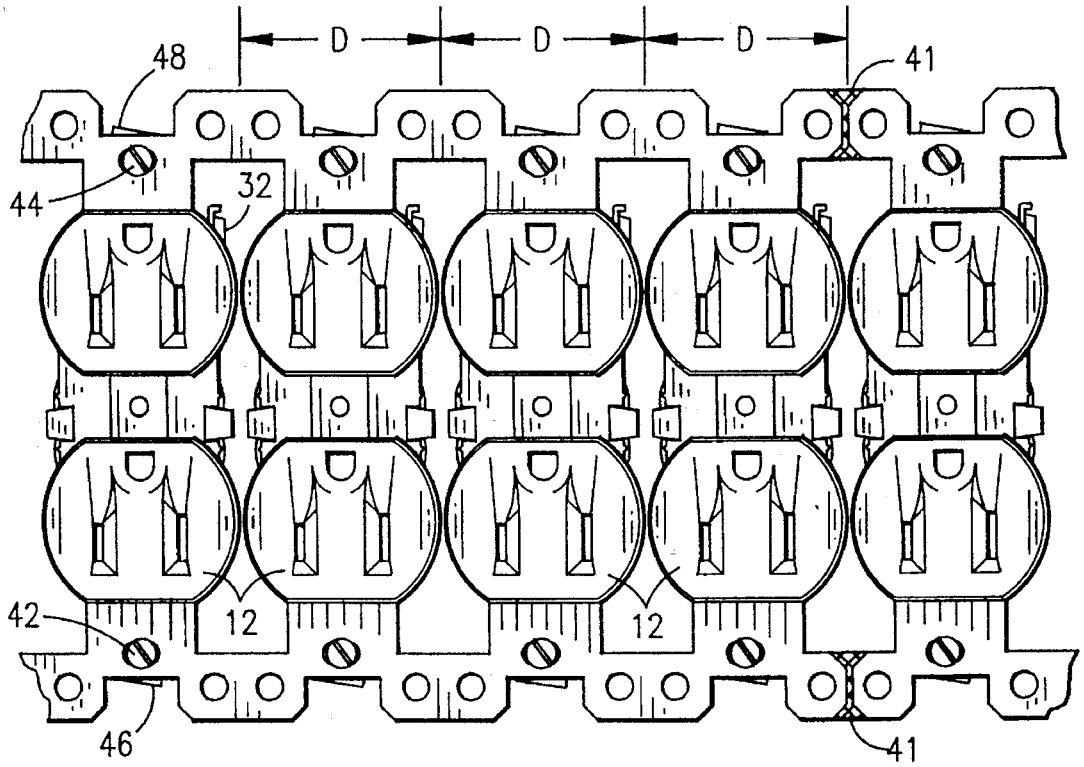
FIG. 3 is a top plan view of a succession of assembled receptacles joined at each end by portions of the sheet metal strip from which the mounting straps are formed.
Figure 4:
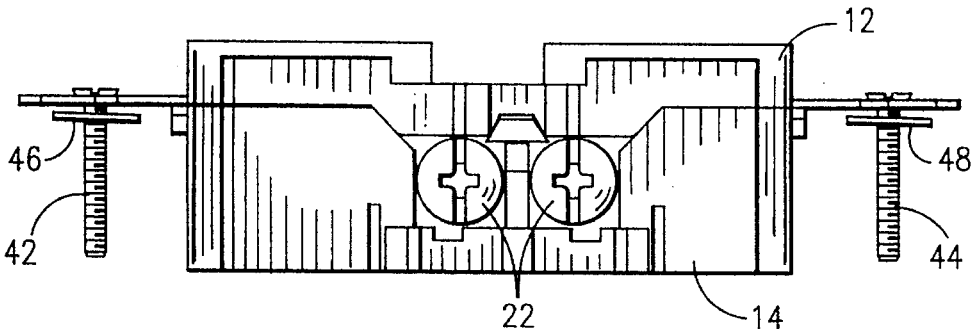
FIG. 4 is a side elevational view of the receptacles of FIG. 3.
Figure 5:
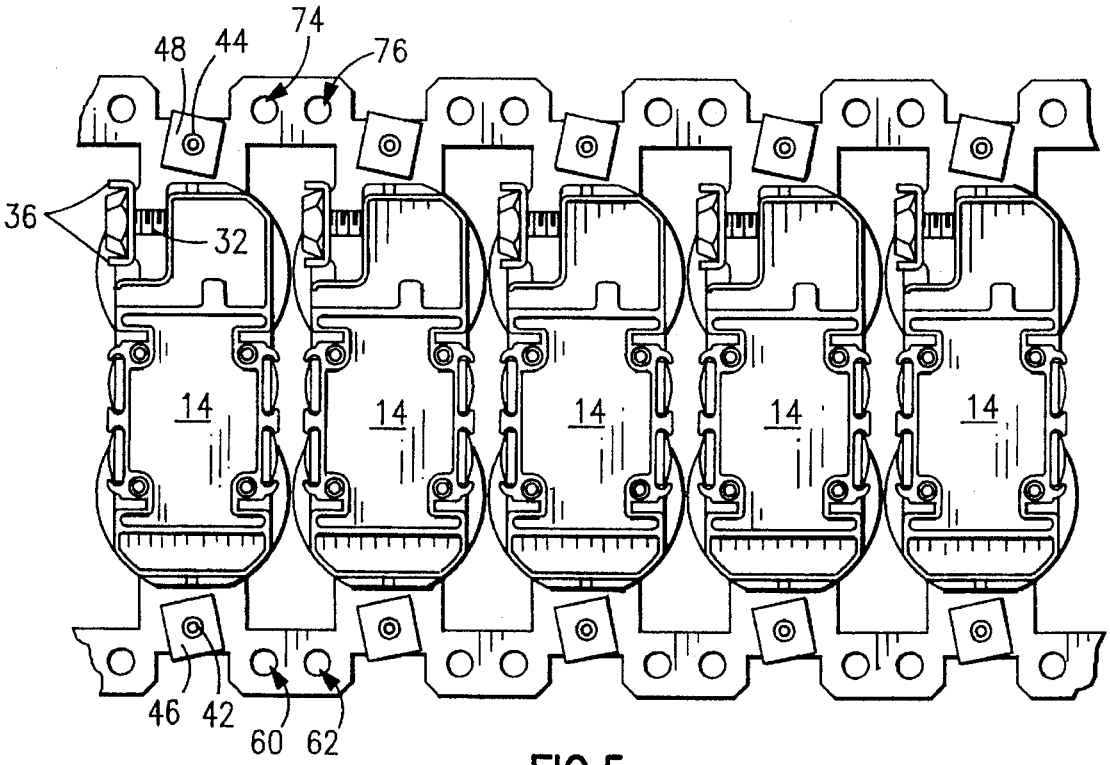
FIGS. 5 and 6 are bottom plan and end elevational views thereof, respectively.
Figure 6:
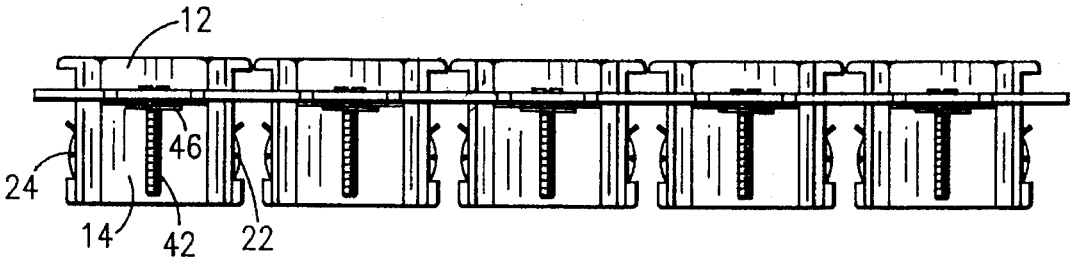

The present invention is concerned with automated assembly of receptacle 10, or other wiring devices having a mounting strap with end portions extending outwardly from opposite ends of the device. In FIGS. 3–6 are shown a plurality of receptacles 10 in side-by-side relation, end portions 38 and 40 of the mounting strap of each receptacle being integrally attached to the strap end portions of the adjacent receptacles on both sides. Receptacles 10, as will be explained in detail hereinafter, have been assembled according to the present invention, in a series of steps involving sequential movement of the continuous strip of material from which the mounting straps are formed in a direction parallel to the longitudinal axis of the strip. The strip is moved in increments equal to the width of the mounting strap end portions 38 and 40, plus the width of a scrap portion (e.g., 0.080"), one of which is indicated in the shaded portion of FIG. 3 denoted by reference numeral 41. The incremented distance of travel is indicated in FIG. 3 by distance D.

Figures 7, 8, 9, 10:
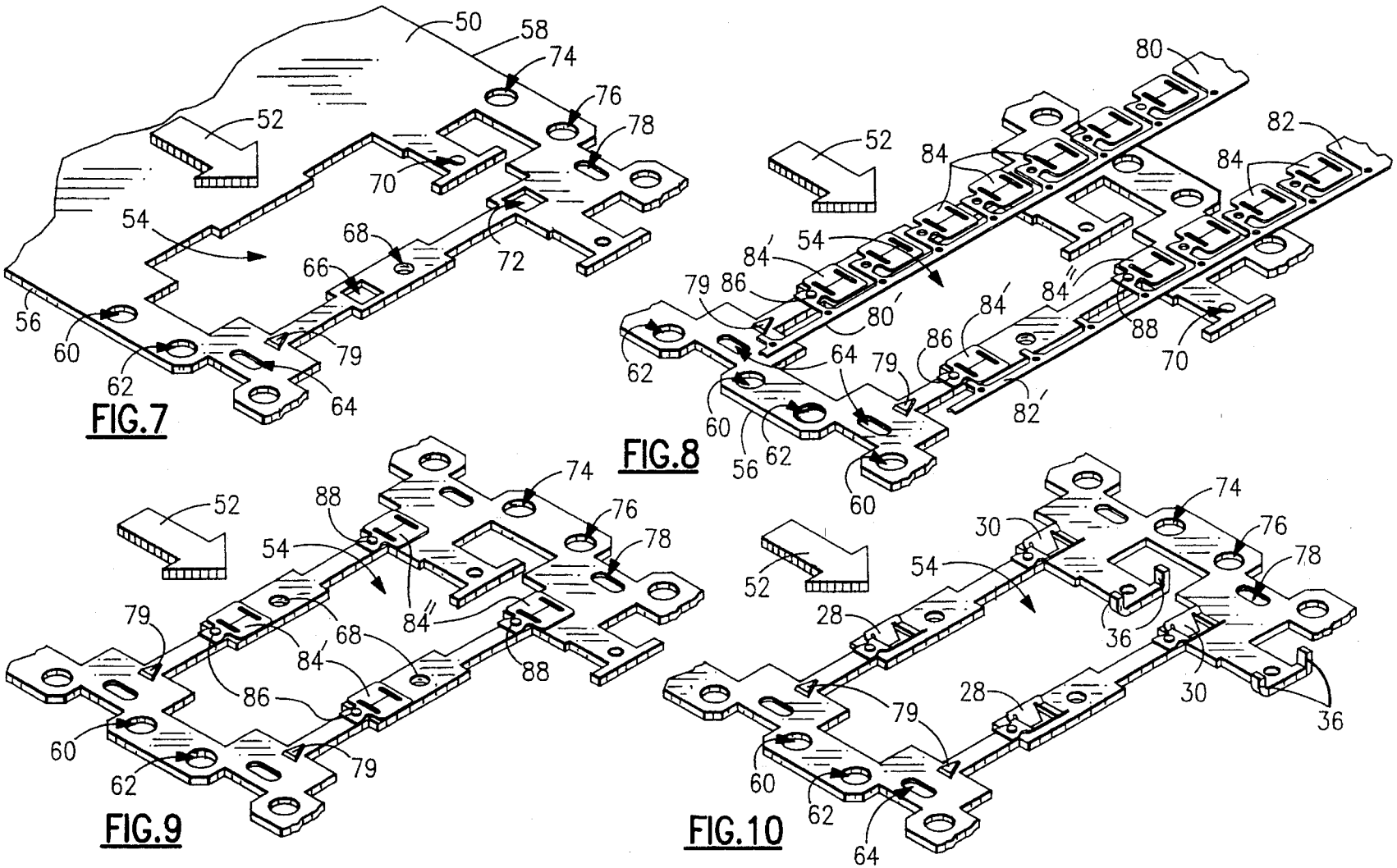
FIGS. 7 through 17 are perspective views showing the elements of the receptacle of FIG. 1 in a succession of forming and assembly steps to illustrate the sequence of steps in the assembly of a finished receptacle according to the present invention.

Referring now to FIG. 7, an elongated strip 50 of the sheet metal from which the mounting straps are formed is fed from a supply (not shown) in the direction of arrow 52, i.e., along the longitudinal axis of strip 50. Strip 50 is alternately moved (by distance D) and stopped, the forming and assembly operations being performed simultaneously at successive positions or stations while the strip is in a stationary position. The first step in the process is the cutting or punching by conventional tooling (not shown) of predetermined areas of strip 50. A relatively large area, denoted by reference numeral 54, between side edges 56 and 58 is removed from the strip leaving a cut-out area bordered by a continuous succession of straight lines. At the same time, a number of holes are punched in strip 50, such holes being indicated by reference numerals 60, 62, 64, 66, 68, 70, 72, 74, 76 and 78. Also, a small embossed area 79 is formed inwardly of opening 64 for purposes of strengthening the mounting strap. Internal threads are formed in holes 68 and 70 by conventional taps.

At the two operational stations following that shown in FIG. 7, a pair of additional sheet metal strips 80 and 82 are fed from separate supplies (not shown) in parallel directions, perpendicular to the direction of movement of strip 50. The longitudinal axes of strips 80 and 82 are spaced by distance D. Strips 80 and 82 are alternately moved and stopped, in the same manner as strip 50, and are punched and cut by appropriate tooling at positions laterally adjacent strip 50 to form a succession of mutually connected blanks 84, such blanks being identical in the two strips.

Strip 80 is fed forwardly above the portion of strip 50 which lies between two successive cutout areas 54 until the endmost blank 84' is in covering relation to opening 66, as shown in FIG. 8. Blank 84' is then cut from strip 80, moved downwardly a small distance and staked to strip 50 at the position indicated by reference numeral 86. Likewise, strip 82 is fed forwardly until the endmost blank 84" is in covering relation to one of openings 72 in strip 50. Blank 84" is severed from strip 82 and staked to strip 50 at 88. It will be noted that the configuration of elements is such that blanks 84' and 84" may be severed adjacent an edge portion of cutout area 54. Scrap portions 80' and 82' of strips 80 and 82, respectively, which remain after removal of blanks 84' and 84" are severed after passing edge 56 of strip 50.

After attachment of blanks 84' and 84" to the portions of strip 50 separating cutout areas 54, strip 50 comprises a series of mutually attached blanks for the formation of mounting straps, as seen in FIG. 9. Blanks 84' and 84" are then bent by suitable tooling so that portions extend into openings 66 and 72, as seen in FIG. 10, the blanks now forming completed ground contacts, numbered 28 and 30, respectively, as in FIG. 1. Such contacts will resiliently engage the grounding prongs of electrical plugs which are connected to receptacle 10. At the same time, ears 36 are bent upwardly on the mounting strap blanks.

Figure 12:
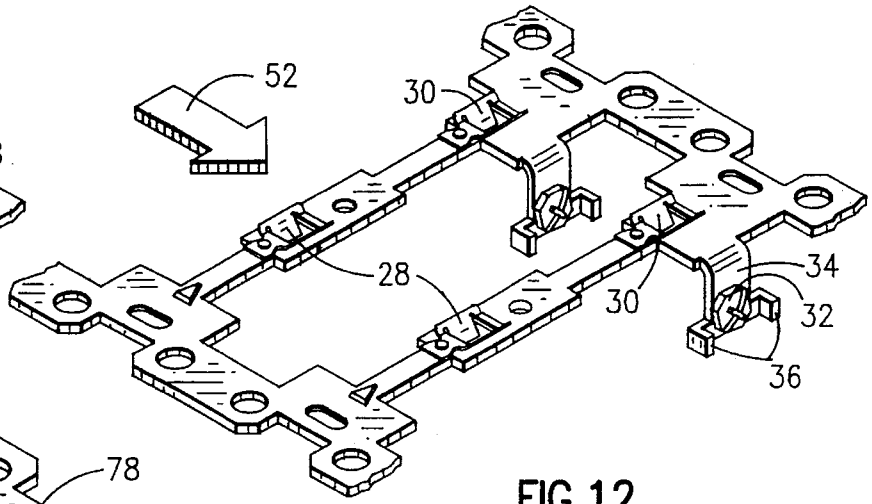
Figure 11:
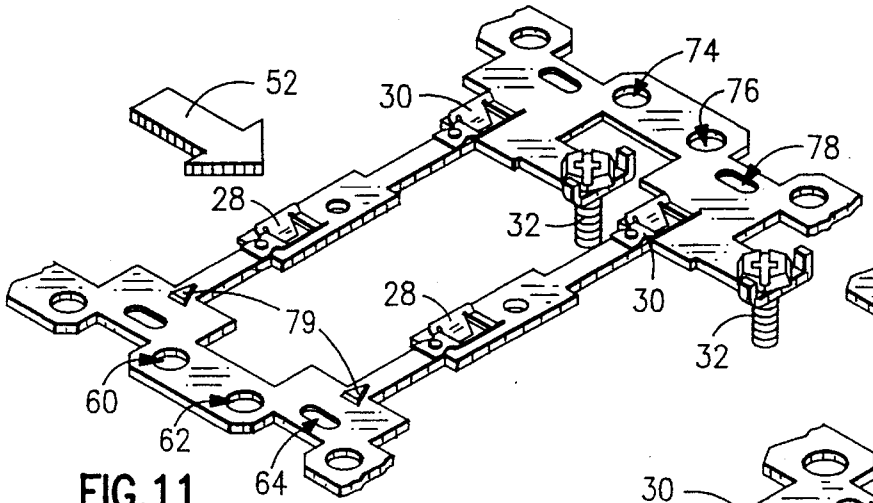
Figure 13:
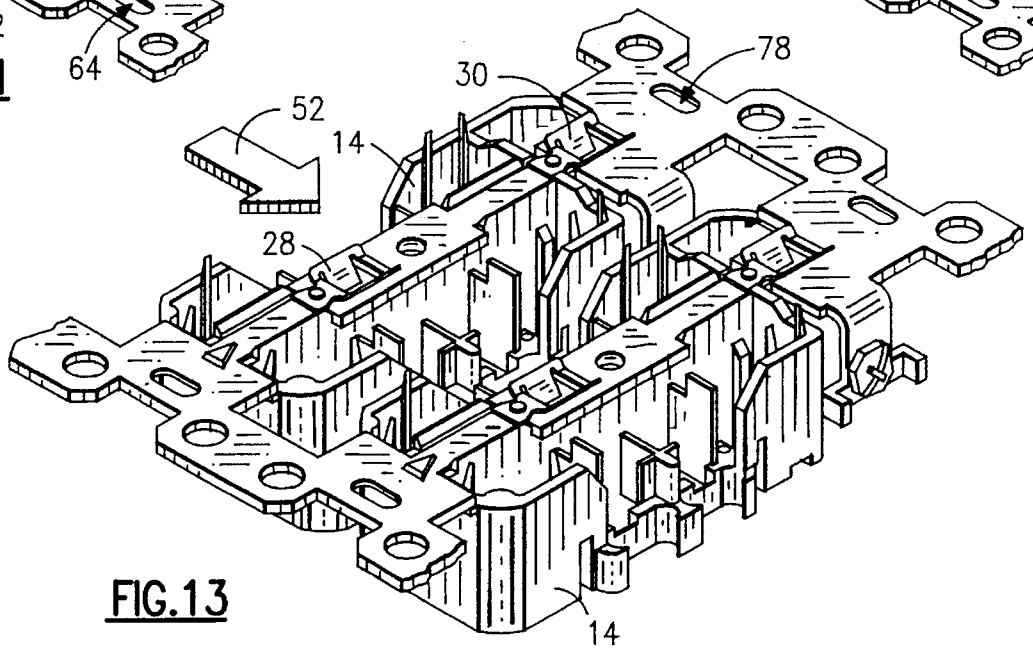

At succeeding operational stations, openings 70 are tapped, screws 32 are threaded into openings 70, and tabs 34 are bent downwardly, as seen in FIGS. 11 and 12, respectively. Assembly of the other components, which have been separately fabricated, with the mounting strap blanks is performed as strip 50 is advanced to succeeding operational stations. The first such step, as illustrated in FIG. 13, is the upward movement of bases 14 into mating relation with the mounting strap blanks. As explained more fully in the previously referenced application, this relation is defined by portions of the mounting strap being placed between and upon wall portions of base 14, which are then slightly deformed at appropriate locations to provide a staked connection between the bases and mounting strap blanks.

Figure 14:
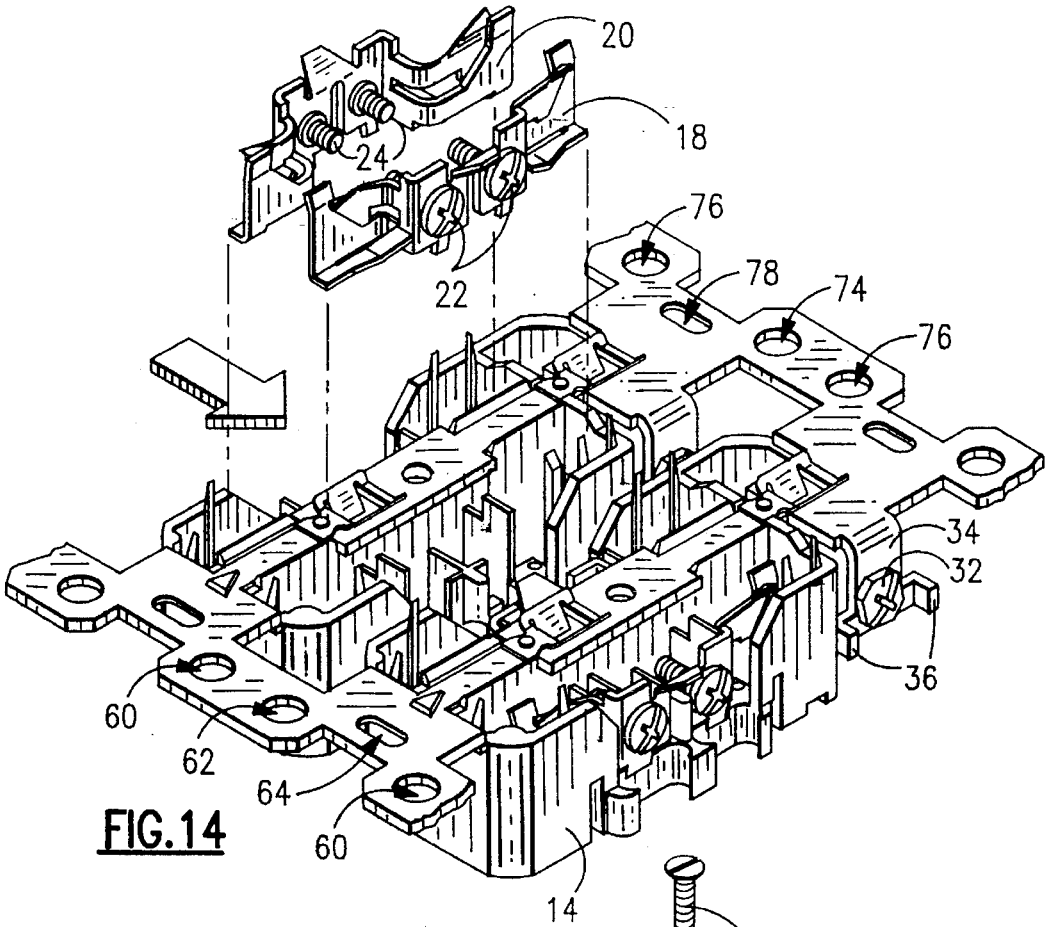
Figure 15:
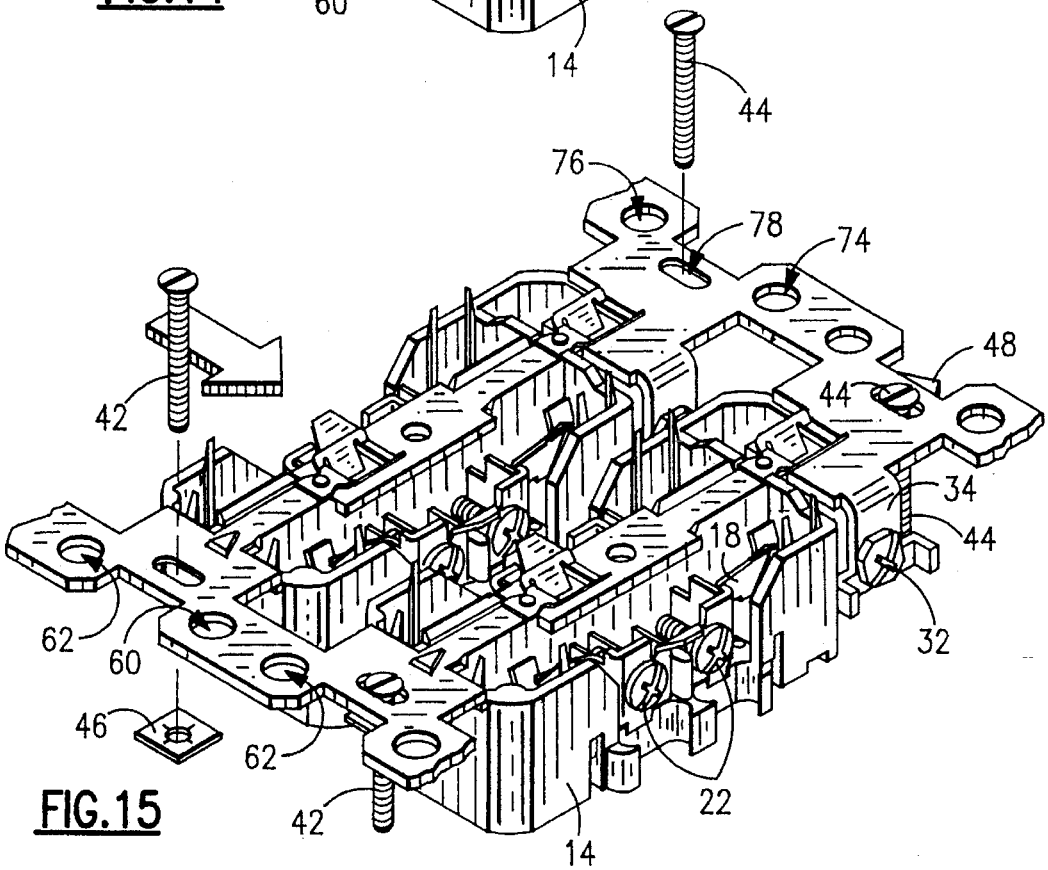
Figure 16:
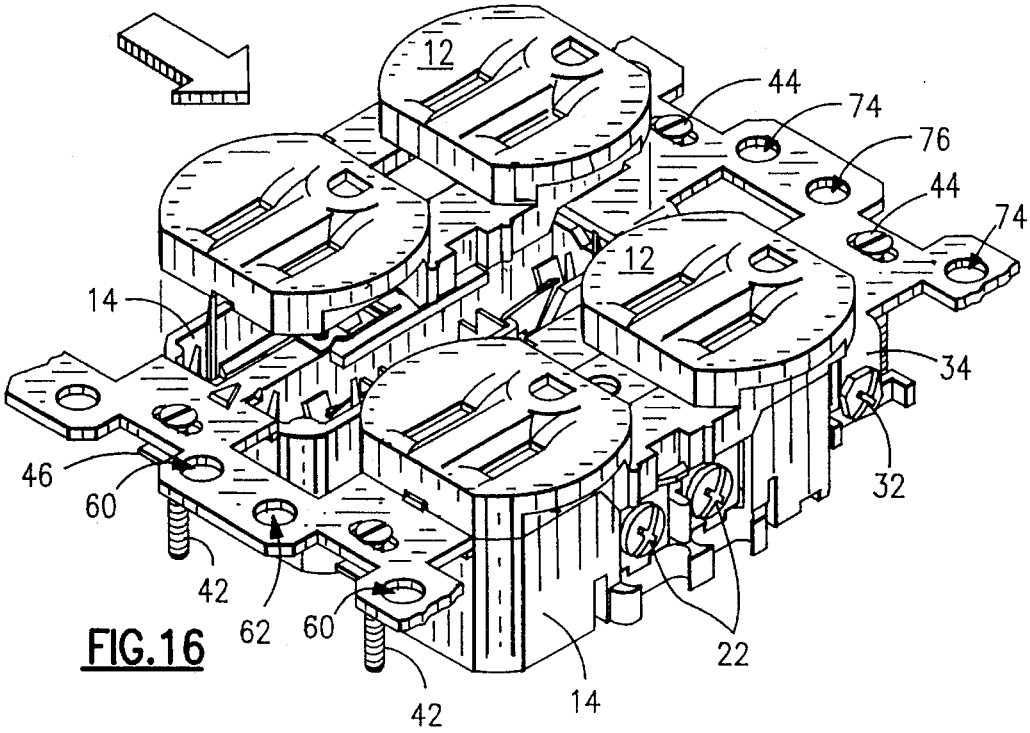

Bases 14 are supported in this position at subsequent stations where terminals 18 and 20 are moved downwardly into appropriately formed recesses in bases 14, and mounting screws 42 and 44 are inserted through openings 64 and 78, respectively, as seen in FIGS. 14 and 15. Also, cardboard retainers 46 and 48 are moved upwardly to engage the threaded portions of the screws adjacent openings 64 and 78. Covers 12 are then moved downwardly into mating relation with bases 14, as shown in FIG. 16, with medial portions of the mounting strip blanks captured between, and end portions of the strap extending outwardly from the cover and base. Opposing surfaces of cover 12 and base 14 are then permanently joined by ultrasonic welding of the thermoplastic materials from which the cover and base are molded.

Figure 17:
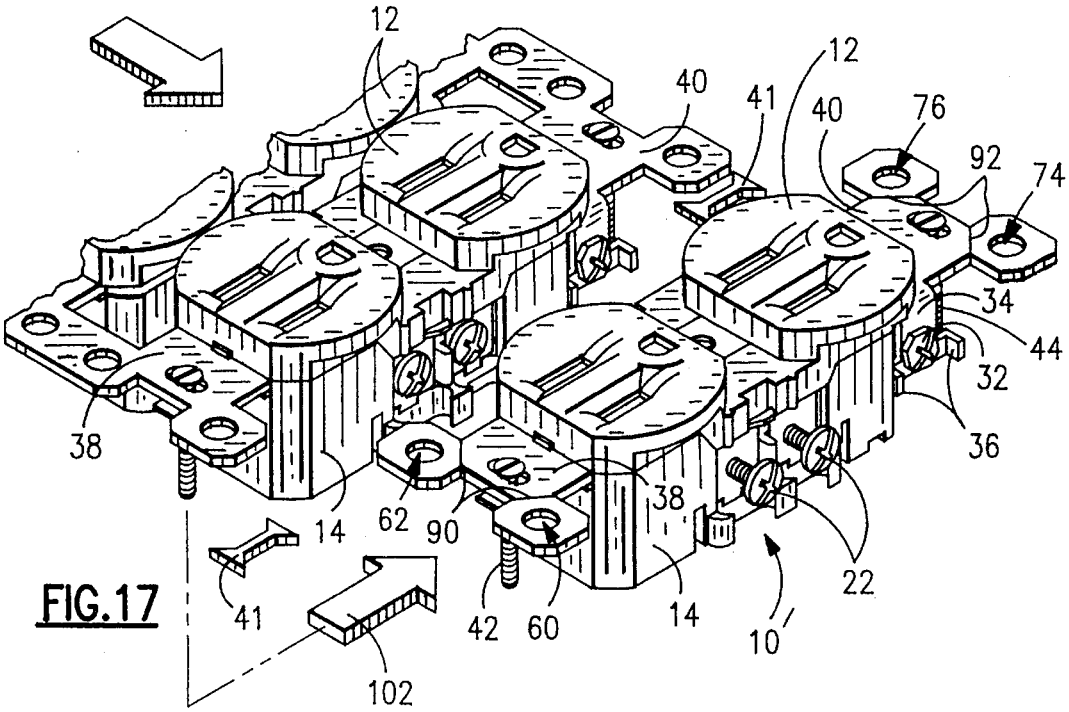

The final steps in the assembly operation are then performed, as shown in FIG. 17. By simultaneous cuts, scrap pieces 41 are severed from between endmost receptacle 10' and the next preceding receptacle. Scrap pieces 41 taper outwardly on both sides and at both ends to provide angled corners on the mounting strap ears. The scrap portions provide the necessary spacing between succeeding receptacles while keeping the width of the mounting strap ears at the desired dimension. At the same time the scrap is cut, score marks 90 and 92 are formed to permit easy removal, if desired at the time of installation, of the mounting strap ears. If desired, electrical testing of the receptacles may be performed prior to severing thereof from the continuous strip.

The severed receptacle, indicated by reference numeral 10', drops downwardly from the strip and is moved laterally, as indicated by arrow 102, to a position where robotic screwdrivers (not shown) back out terminals screws 22 and 24 so that the receptacle is in a condition ready for installation and wiring. Screws 22 and 24 are fully inserted in their respective threaded openings during the assembly operations in order to provide the necessary clearance between adjacent receptacles while mutually attached in the continuous strip.

From the foregoing, it will be understood that the present invention provides a method of forming receptacle mounting straps in a continuous, essentially rigid strip, and assembling therewith all other elements of the receptacle in a rapid, efficient and fully automated manner. It will also be understood that while all stations at which operations are performed have been illustrated, these are not necessarily immediately successive stationary positions of the strip; that is, in order to provide the necessary room for tooling. The strip may be indexed more than once between successive operations. In any event, the continuous and essentially rigid nature of strip 50 provides the necessary precise positioning of the elements at each operational station.

What is claimed is:

1. A method of automatically assembling wiring devices in a continuous sequence, said method comprising:

a) moving an elongated strip of sheet metal in a linear direction parallel to the longitudinal axis of said strip;

b) forming in said strip a continuous succession of mutually attached blanks elongated between opposite ends along parallel axes perpendicular to said linear direction, said blanks being suitable for forming mounting straps for said wiring devices;

c) assembling all other elements of said wiring device with said mounting strap blanks while the latter remain mutually attached; and d) severing the endmost of said mounting strap blanks from the immediately preceding mounting strap blank, thereby providing an assembled wiring device having a mounting strap.

2. The method of claim 1 wherein said moving of said mounting strip is performed by alternately advancing said strip by a fixed distance and holding said strip stationary.

3. The method of claim 1 wherein said strip has a uniform width and said mounting strap blanks have a length between said opposite ends equal to said width.

4. The method of claim 1 wherein said other elements include initially separate front and rear housing sections, and said assembling step includes moving said front and rear housing sections into mutual engagement from opposite sides of said mounting strap blanks.

5. The method of claim 4 wherein each of said housing sections are assembled with said mounting strap blanks in portions thereof between said opposite ends, whereby said mounting strap ends extend outwardly from said housing sections.

6. The method of claim 1 wherein said forming of said blanks includes fixedly attaching thereto at least one diverse member prior to said assembling of said other elements with said blanks.

7. The method of claim 6 wherein said diverse member is a second blank severed from an end portion of a second strip wherein a continuous succession of said second blanks are formed.

8. The method of claim 7 and further including moving said second strip in a second linear direction to place said second blank in covering relation to a predetermined portion of one of said mounting strap blanks.

9. The method of claim 8 wherein said second linear direction is perpendicular to said longitudinal axis.

10. The method of claim 9 and including the further step of forming said second blank, subsequent to said fixedly attaching step, to provide a female electrical contact for receiving an electrical plug blade.

11. The method of claim 1 wherein said forming of said blanks includes removing areas of said strip between opposite, outer side edges thereof, leaving said strip intact in areas adjacent each of said side edges, said removing step being performed while said strip is stationary.

12. The method of claim 11 wherein said severing of said endmost blank from said preceding blank is performed in said areas adjacent each of said side edges.

13. The method of claim 12 wherein said forming of said blanks includes punching apertures at predetermined positions in said strip and forming threads in at least one of said apertures of each of said blanks.

14. The method of forming mounting straps of an electrical wiring device and assembling therewith other elements of said device to provide a continuous succession of fully assembled devices, said method comprising:

a) moving an elongated strip of sheet metal having parallel side edges by alternately advancing said strip in a direction parallel to said side edges and holding said strip in a stationary position, said strip being thus advanced in equal increments through a plurality of operational stations with an endmost of said stations at the terminal end of said strip;

b) removing predetermined portions from said strip at one of said stations to form in said strip a continuous succession of blanks suitable for forming said mounting straps, said blanks remaining attached to one another by portions of said strip throughout said operational stations;

c) assembling with said blanks at selected ones of said stations a plurality of said other elements, including moving a pair of housing sections into mutually mating engagement from opposite sides of said strip, said housing sections when in said engagement enclosing a portion of one of said blanks, to provide at said endmost station a fully assembled one of said wiring devices; and d) severing said strip at a position adjacent said endmost station to free said one device from said strip in a fully assembled condition.

15. The method of claim 14 wherein said mounting straps have an end-to-end length equal to the width of said strip between said side edges.

16. The method of claim 14 wherein severing is performed in an area of said strip closely adjacent at least one of said side edges.

17. The method of claim 14 wherein said wiring devices are wall receptacles for receiving blades of electrical plugs, and said assembling steps include placement in predetermined position of terminal means having female contacts for receiving said blades.

18. The method of claim 17 wherein said mounting straps include at least one ground contact for receiving a grounding prong of said plugs, said method further comprising fixedly attaching said ground contact to one of said blanks at one of said stations.

19. The method of forming mounting straps of an electrical wiring device and assembling therewith other elements of said device to provide a continuous succession of fully assembled devices, said method comprising:

a) moving an elongated strip of sheet metal having parallel side edges by alternately advancing said strip in a direction parallel to said side edges and holding said strip in a stationary position, said strip being thus advanced in equal increments through a plurality of operational stations with an endmost of said stations at the terminal end of said strip;

b) removing predetermined portions from said strip at one of said stations to form in said strip a continuous succession of blanks suitable for forming said mounting straps having an end-to-end length equal to the width of said strap between said side edges, said blanks remaining attached to one another by portions of said strip throughout said operational stations;

c) assembling with said blanks at selected ones of said stations a plurality of said other elements to provide at said endmost station a fully assembled one of said wiring devices; and d) severing said strip at a position adjacent said endmost station to free said one device from said strip in a fully assembled condition.

20. The method of forming mounting straps of an electrical wall receptacle including terminal means having female contacts for receiving blades of electrical plugs and assembling therewith other elements of said receptacle to provide a continuous succession of fully assembled receptacles, said method comprising:

a) moving an elongated strip of sheet metal having parallel side edges by alternately advancing said strip in a direction parallel to said side edges and holding said strip in a stationary position, said strip being thus advanced in equal increments through a plurality of operational stations with an endmost of said stations at the terminal end of said strip;

b) removing predetermined portions from said strip at one or more of said stations to form in said strip a continuous succession of blanks suitable for forming said mounting straps, said blanks remaining attached to one another by portions of said strip throughout said operational stations;

c) assembling with said blanks at selected ones of said stations a plurality of said other elements, including placement in predetermined position of said terminal means, to provide at said endmost station a fully assembled one of said receptacles; and d) severing said strip at a position adjacent said endmost station to free said one receptacle from said strip in a fully assembled condition.

* * * * *